US005746571A

United States Patent [19]

Dietschi et al.

[11] Patent Number: 5,746,571

[45] Date of Patent: May 5, 1998

[54] PROCESS FOR THE INITIAL OPERATION OR CHANGEOVER OF A SHEET METAL PROCESSING MACHINE AND A MODULAR MAGAZINE FOR CARRYING OUT THE PROCESS

[75] Inventors: Roland Dietschi, Unterlunkhofen; Gideon Levy, Orselina, both of Switzerland

[73] Assignee: Elpatronic AG, Zug, Switzerland

[21] Appl. No.: 563,223

[22] Filed: Nov. 27, 1995

[30] Foreign Application Priority Data

Nov. 28, 1994 [CH] Switzerland ..... 03-575/94
Dec. 22, 1994 [CH] Switzerland ..... 03-881/94

[51] Int. Cl.[6] ..... B65G 59/06

[52] U.S. Cl. ..... 414/795.7; 414/792.8; 414/786; 414/900; 271/98; 271/106; 271/171

[58] Field of Search ..... 414/797, 797.9, 414/795.5, 795.7, 792.8, 793.4, 286, 900; 271/97, 98, 99, 105, 106, 171

[56] References Cited

U.S. PATENT DOCUMENTS

| | | | |
|---|---|---|---|
| 3,527,367 | 9/1970 | Bivans | 221/298 |
| 4,712,783 | 12/1987 | Selak | 271/171 |
| 4,870,241 | 9/1989 | Gysi | 219/64 |
| 4,886,261 | 12/1989 | Jeschke | 271/105 |
| 5,031,892 | 7/1991 | Stieger | 271/10 |
| 5,096,370 | 3/1992 | Mohr | 414/795.5 |
| 5,110,110 | 5/1992 | Wirz et al. | 271/97 |
| 5,181,709 | 1/1993 | Okada et al. | 271/97 |
| 5,372,066 | 12/1994 | Proctor | 271/97 |
| 5,395,103 | 3/1995 | Gysi et al. | 271/11 |

FOREIGN PATENT DOCUMENTS

| | | |
|---|---|---|
| 671 945 | 10/1989 | Switzerland . |
| 0 406 608 | 1/1991 | Switzerland . |
| 0 575 707 | 12/1993 | Switzerland . |

OTHER PUBLICATIONS

Ingenious Mechanisms, vol. 3 *Work Feeding and Transfer Mechanism*, pp. 404–405 (1951).

Fundamentals of Automation, Published by Chuan Hua Publication Co., (1988), pp. 184, 185, 190, 191, 196–199, 208–211.

*Primary Examiner*—Karen B. Merritt
*Assistant Examiner*—Douglas A. Hess
*Attorney, Agent, or Firm*—McCormick, Paulding & Huber

[57] ABSTRACT

For the initial operation or changeover of a can body welding machine, a modular stack magazine to guide and hold a stack of blanks has adjustable stack supports with holding surfaces projecting under the lowermost blank. These stack supports are adjustably mounted on a frame which is releasably connected to a blank separating device. To assist the destacking of individual blanks, adjustable spreading air feed elements are also fitted to the frame. These adjustable components together with the frame form an exchangeable module, so that once their settings have been carried out—the setting operations being inherently complex, because as they are governed by many other parameters besides size of blank they have to be arrived at empirically, and they must be made all over again if just one of those parameters is altered—the module can be stored ready for reuse after maintenance operations, or after the use of another module.

13 Claims, 3 Drawing Sheets

PROCESS FOR THE INITIAL OPERATION OR CHANGEOVER OF A SHEET METAL PROCESSING MACHINE AND A MODULAR MAGAZINE FOR CARRYING OUT THE PROCESS

BACKGROUND OF THE INVENTION

This invention relates to a process for the initial operation or changeover of a sheet metal processing machine, and also a modular magazine for carrying out the process.

Stack magazines and separating devices for sheet metal blanks are known and are used on many sheet metal processing machines and also, for example, on conventional can-making machines, where the separating mechanism is subject to extremely demanding requirements: on machines of medium capacity, up to 500 sheet metal blanks per minute have to be separated, and on high-output machines, up to 1000 per minute. The adjustable stack supports of the stack magazine are formed eg. as four angle sections associated with the corners of the stack, and these have to be adjusted with respect to one another whenever there is a change of blank size. To enable individual blanks to be removed from the stack at the stated rate, it is also known to assist the clean separation of the individual blanks from the stack by supplying spreading air. To ensure that the bottom blank which is grasped and conveyed by the separating device sags by the necessary and precisely defined amount, separation catches which project underneath the bottom blank need to be exactly positioned; a different positioning has to be adopted for every size of blank, grade of material, and type of coating. Both the adjustable spreading air elements which this requires and the stack supports needed for guiding and holding the stacks of blanks are machine-linked, that is to say they are located on the machine itself, close to the magazine. To the stated setting parameters (spreading air, separation catches) it is necessary to add the clearance between the bottom blank and the separating means. This clearance varies according to the characteristics of the blank to be separated, but remains constant for that blank.

Whenever there is a switchover to another product, be it another size or another material, all settings have to be completely remade. The settings have to be made with great accuracy, as whilst on the one hand the stack must be adequately held in the magazine, it must be possible for individual blanks to be withdrawn easily by the blank separating device or destacker. For example, depending on the blank size, material or thickness (thin blanks which are apt to flutter easily are particularly difficult to control), but also depending on the coating of the blanks or the thickness of the oil layer on the surface of the blanks, completely different conditions have to be taken into account when setting eg. the stack supports, the spreading air elements (position, orientation and flow of the air jet) and the clearance of the separating device. In view of the large numbers of parameters to be taken into account, it is not possible to formulate setting instructions which will guarantee trouble-free separation. The operating instructions of such machines include a preferred basic setting with a further instruction that settings should be fine-tuned until all parameters have been established on an empirical basis and are correctly balanced.

These lengthy procedures can only be carried out by an expert for the initial operation of the machine, and cause prolonged down times. Major interruptions of production also occur after maintenance work, for example on the destacker (which can be accessed only by dismantling the stack magazine and by shifting the surrounding auxiliary elements out of the way), as the settings then have to be made all over again, ie. they have to be determined again on an empirical basis. The result is significant loss of production, especially in the case of high-capacity machines producing for example up to 1000 cans per minute.

It is a basic object of the present invention to provide a process for the initial operation or changeover of a sheet metal processing, eg. a can body welding, machine which allows an initial production run or a changeover to another product (a change of blank size and/or material) to be effected in a shorter time and in a straightforward way, ie. without involving an expert, by the line personnel.

SUMMARY OF THE INVENTION

The present invention resides in a process for the initial set up or changeover of a sheet-metal processing machine such as a can body welding machine. With respect to the sheet-metal blanks which are to be processed by the machine and, in particular, blanks to be welded into can bodies and which have predetermined characteristics such as a particular blank size and/or alloy and/or surface condition, the blanks to be processed are individually fed from a magazine by means of a separating device which transports them onward to a processing station. The invention is characterized in that a modular and portable magazine for the sheet metal blanks is connectable to the machine and has at least one auxiliary device for separation of the sheet metal blanks. The operating parameter or parameters of the auxiliary device or devices have been pre-set to an operative condition to suit the characteristics of the sheet-metal blanks being processed.

The invention also resides in the modular magazine for the sheet-metal blank processing machine. The magazine has a separating device for blanks to be individually fed from the magazine at a high rate and has adjustable stack supports to receive the stacks of blanks of different sizes. The magazine is characterized by a frame provided with one or more auxiliary devices for the separation and/or withdrawal of individual blanks.

The invention also comprises a sheet-metal processing machine, such as a can body welding machine, with a modular magazine as described above.

Incorporating the auxiliary elements for separation (spreading air, etc.) not in the machine itself, but in the frame of a modular magazine allows the settings to be stored by removal of the magazine. This in turn allows a modular magazine to be set correctly with the aid of specimen or test blanks eg. on a test bench at the manufacturer's or at some other location where experts are available (eg. at a central location of the line operator). The magazine, now ready for use, can easily be mounted on the machine, so that the changeover time (or time needed for initial operation) is reduced to a minimum, and the presence of experts on the spot is no longer necessary.

BRIEF DESCRIPTION OF THE DRAWINGS

An embodiment of the modular stack magazine according to the invention is illustrated in the drawing by way of example, and will now be described in detail.

DESCRIPTION OF THE PREFERRED EMBODIMENTS

Figure 1:
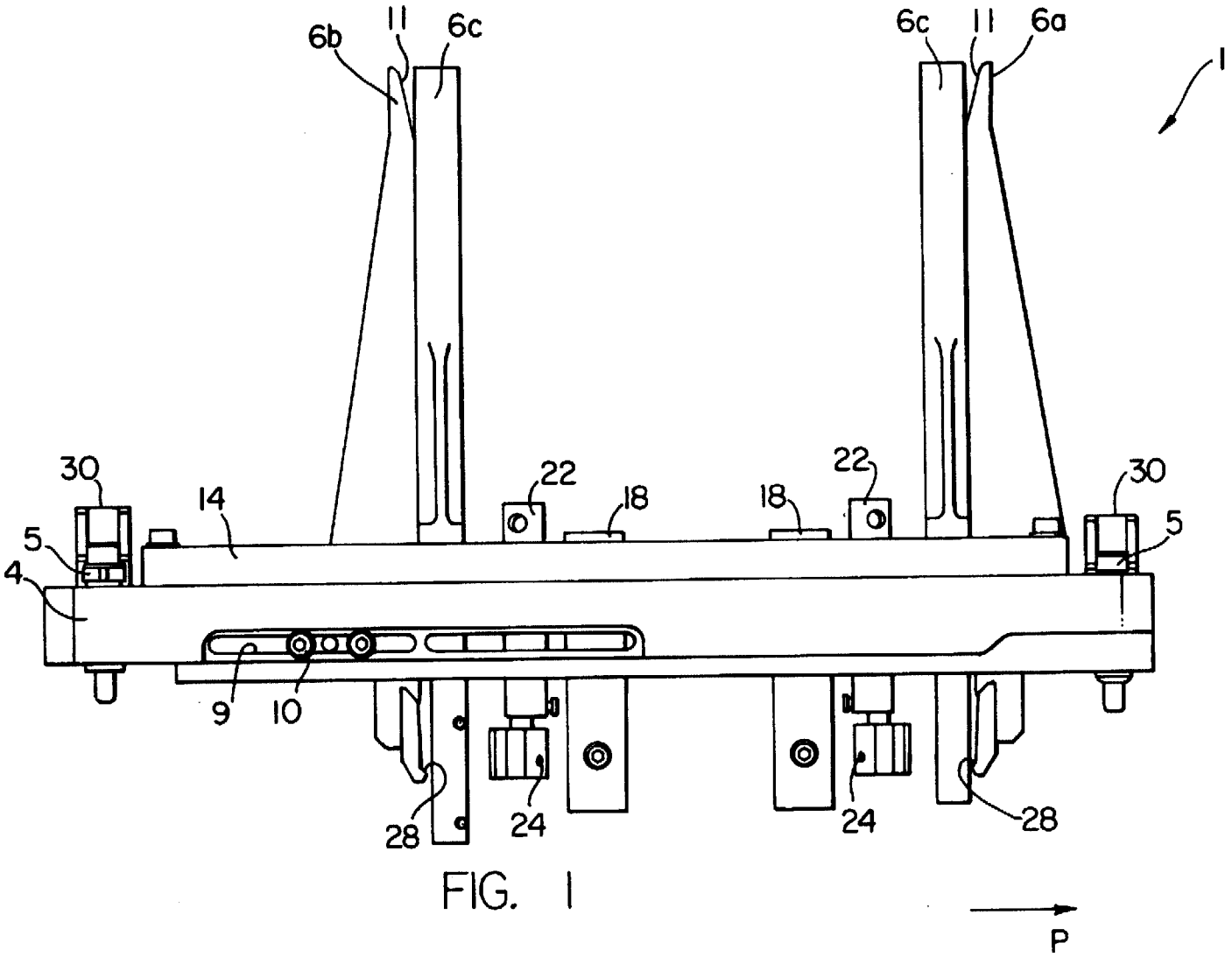
FIG. 1 shows the stack magazine in elevation.

In the drawing, a stack magazine 1 for sheet metal blanks, for example for a can-making machine, is shown empty. The stack magazine 1 has a frame 4 which is located by means of setting screws 5 (on a welding machine of a known type—see eg. U.S. Pat. No. 4,870,241—which has been omitted in order not to complicate the drawing). The welding machine has a separating device eg. according to U.S. Pat. No. 5,395,103 or 5,031,892 (likewise omitted). In a manner known in itself, the blank separating device of the machine seizes, for example by suction, the bottom blank of a stack (not shown) which has been inserted into the stack magazine 1 from above, and then transports it in the direction of the arrow P in FIG. 1 for further processing.

A number of stack supports 6 and 18 are arranged on the frame 4 to guide and hold the stack. Viewed in the direction of the arrow P, the front stack supports are designated 6*a* and the rear stack supports 6*b*. Lateral stack supports 18 and 6*c*,6*d* are also provided. The front stack supports 6*a*, the rear stack supports 6*b* and the lateral stack supports 18 are provided at their lower ends with inwardly directed retaining surfaces 28 which project under the stack; the stack supports 6*c*,6*d* do not carry these surfaces, and are merely intended to act as guides mainly for the upper region of the stack. The retaining surfaces 28 define the lower edge of the stack. The vertical position of this edge can be adjusted with respect to the blank separating device by means of the setting screws 5, thus determining the gap between the bottom blank and the separating device.

To facilitate insertion of a stack of blanks into the stack magazine 1, the upper ends of the stack supports 6 are provided with bevels 11.

Figure 3:
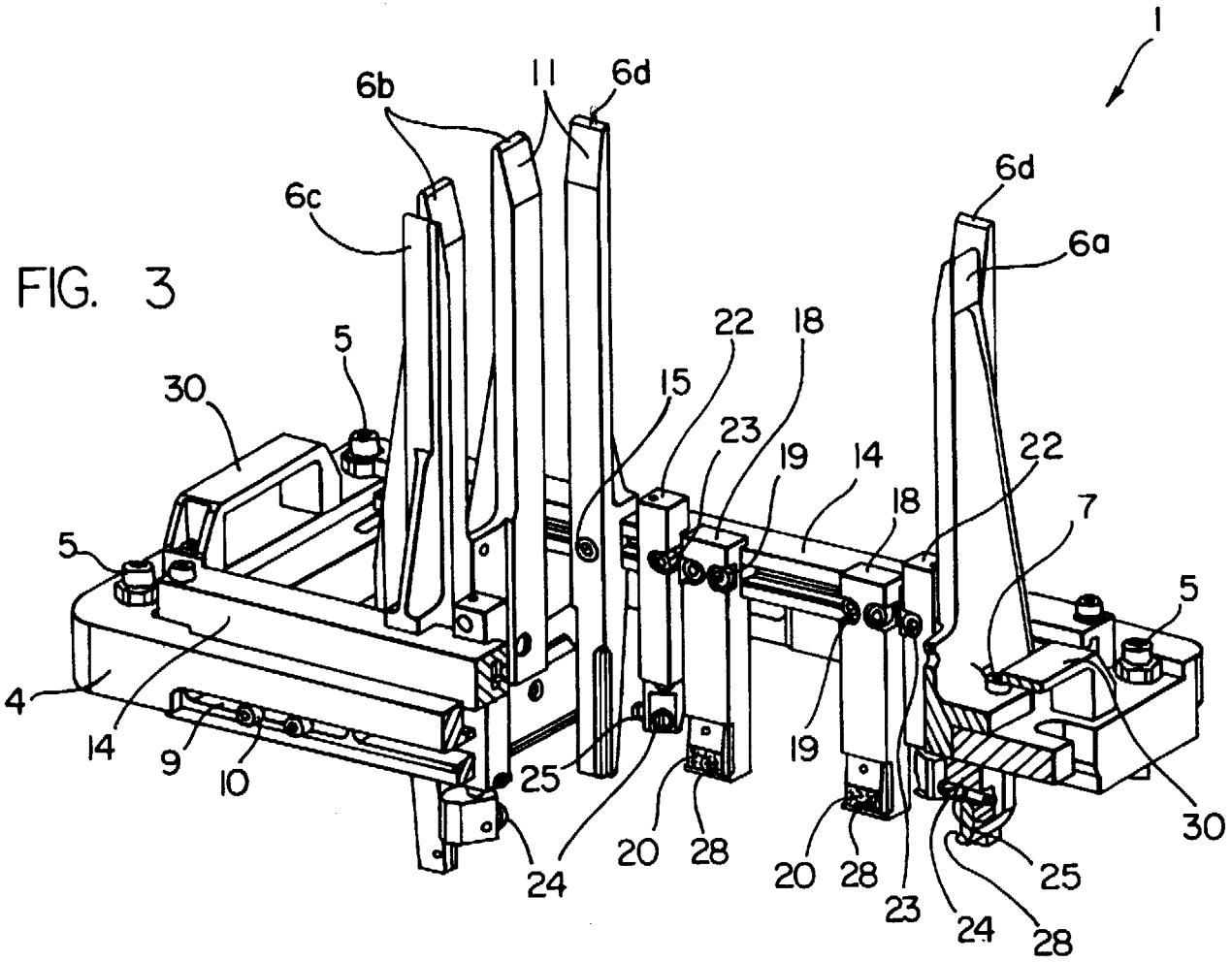
FIG. 3 shows another perspective view of the stack magazine, partly in section.

The distance between forward and rear stack supports 6*a*,6*b* corresponds eg. to the developed circumference of a can (π.d), while the distance between the lateral supports 18;6*c*,6*d* corresponds to the height of the can, or of its body. Whereas, in the illustrated example, the front stack supports 6*a*, which form a single unit, are permanently fixed to the frame 4 by means of screws 7 (FIG. 3), the rear stack supports 6*b*, which likewise form a single unit, can be adjusted in position to enable the distance to be set as desired. A lower part 8 of the stack supports 6*b* is slidably guided in corresponding recesses 9 in the frame 4, and is fixed in the desired position by means of setting screws 10.

Figure 2:
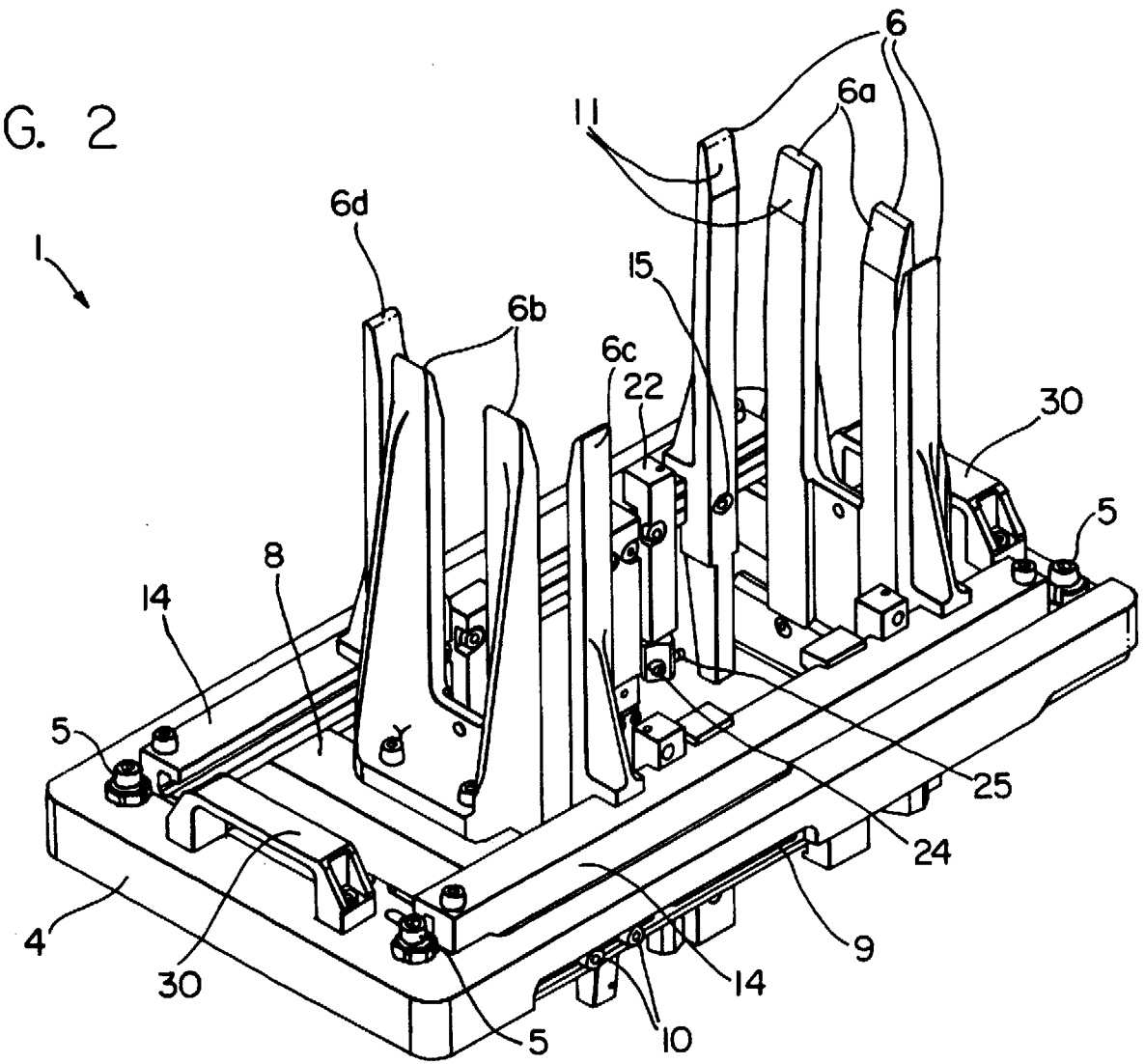
FIG. 2 shows a perspective view of the stack magazine shown in FIG. 1.

Two parallel rail sections 14 are mounted on the frame 4 so as to be adjustable in position relative to one another. To these rails 14, the lateral stack guides 6*c* and 6*d* and also the stack supports 18 are fixable by means of setting screws 15 and 19 respectively (FIGS. 2 and 3), all at the desired distances from one another. Two spreading air feed elements 22 are also adjustably mounted on each of the rail sections 14, and are fixable at the desired position by means of setting screws 23. The stack supports 18 are provided in the lower region with exchangeable separation catch elements having a number of grooved separation catches 20. Each spreading air feed element 22 is provided with a vertically adjustable jet 24 in its lower region, this jet is such that the direction of the jet of air can be selected advantageously with three degrees of freedom with respect to the spreading air feed element 22, by rotation in the horizontal plane, setting of angle to the horizontal, and setting of height relative to the vertical, and can, together with the desired height of the jet be fixed by means of setting screws 25. The spreading air flow is also regulatable, in a conventional manner not illustrated here.

The gap (corresponding to the desired can body height) between the opposing elements acting laterally on the stack of blanks is set by the positioning of the rail sections 14.

Of course, instead of having two stack supports 18 provided with holding surfaces 28 on either side of the sheet stack, it may be sufficient to provide only one such element on either side; alternatively, more than two on either side might be used.

The frame 4 is fitted with two carrying handles 30.

With the construction which has been described, the mode of operation is as follows:

the stack of blanks intended for further processing must be reliably held in th e stack magazine 1, yet easy withdrawal of the bottom blank must be guaranteed when destacking occurs. Above all, it is necessary to avoid double blanks, ie. withdrawal of two blanks which stick together, in the course of the separation process. To fulfill this requirement, the setting of the stack magazine 1 has to be carried out with a high degree of precision. This precision is especially important in the case of high-capacity machines processing for example up to 1000 blanks per minute. Not only is it absolutely essential for the stack supports 6,18 to be precisely set in relation to one another, preferably with an accuracy of 0.3 mm, to suit the size of blank to be processed, but also the separation has to be assisted by the provision of separation catches 20 and by the use of spreading air. The possibilities of issuing setting instructions are limited, as several other aspects besides blank size, thickness and material influence the requirements governing the setting of the stack supports 6,18 and spreading air elements 22. One major factor, for instance, is the surface condition of the sheet metal; depending on whether the blanks are lacquered or unlacquered, whether and how they are printed, whether they are oiled, and whether they flutter, and depending on the hardness etc. of the sheet metal, an optimum setting has to be empirically sought in every case. An important feature, especially in the case of larger blanks, is the sag of the bottom blank under its own weight; this is affected by the positioning of the lateral stack supports 18 along the rail section 14, and is taken into account in the setting of the gap between the frame 4 and the blank separating device (by means of the setting screws 5).

These complex settings of the stack magazine can only be carried out by an expert. All settings have to be remade when there is a change of size, or an alteration to just one of the abovementioned parameters; the setting parameters affect one another, so that an alteration to one parameter makes it necessary to alter another.

According to the invention the adjustable stack supports 6,18, the separation catches 28 and spreading air elements 22, as well as the setting screws 5, which function as spacer elements, are mounted in a simple fashion on the frame 4 which is removable from the destacker, thus forming a module which can be stored for use with the existing settings. Thus the magazine settings which have been arrived at are retained, if a temporary change of size occurs. Such a module can be kept available for every size in the planned production range. A change of module can be performed easily and quickly, even by a less skilled operator, without causing prolonged down times. Even following maintenance work, for example on the destacker, which is now easily accessible since the frame 4 is removable, the machine can be put back into operation quickly without time-consuming magazine settings having to be made all over again. Even if a new setting is necessary, eg. because not enough modules are available, it can be made away from the machine, which can continue running with another module. To make the significance of this improvement clear, it must be realized that a stoppage lasting one hour on a high-capacity can-making machine nowadays means a loss of up to 60,000 cans.

A further advantage lies in the fact that the customer can take delivery of the machine with several modules already prepared, and does not have to carry out the complicated settings himself.

A further advantage is that according to the invention it is also possible to switch a module from one machine to another machine.

The stack magazine according to the invention is particularly suitable for can welding machines operating at very high speeds, but is not restricted to such machines.

We claim:

1. Process for initial operation or changeover of a sheet metal processing machine for sheet metal blanks which are to be processed and have one or more predetermined characteristics, wherein the sheet metal blanks to be processed are individually fed from a magazine having a frame by means of a separating device which transports them to a processing station, comprising the steps of:

presetting one or more operating parameters of at least one auxiliary device of a modular and portable magazine for sheet metal blanks, the at least one auxiliary device being mounted to the frame of the magazine, the magazine having the at least one auxiliary device for the separation of the sheet metal blanks, the one or more operating parameters of the at least one auxiliary device having been preset to an operative condition to suit the characteristics of the sheet metal blanks to be processed; and installing the modular and portable magazine to the sheet metal processing machine by joining the frame to the sheet metal processing machine.

2. Process according to claim 1, wherein the operating parameters preset during the step of presetting include the setting of an air discharge which separates the metal blanks; the setting of separation catches to set the sag of the bottom blank of the stack of sheet metal blanks; and the setting of a clearance between the bottom blank and the separating device using a spacer element to suit a given sheet metal blank to be processed.

3. Process according to claim 1, further comprising the step of:

removing the magazine from the processing machine when a change in the blanks to be processed is desired; and storing the magazine with the existing setting of operating parameters until such time as it is used again for processing similar blanks in the processing machine.

4. Process according to claim 1, wherein the step of presetting the operating parameters is performed using trial blanks on processing machine test bench so that the modular magazine is prepared for operation for a given blank separately from the processing machine.

5. Modular magazine for a sheet metal blank processing machine having a separating device for transferring individual blanks from the magazine at a high rate, comprising:

adjustable stack supports to receive stacks of sheet metal blanks of different sizes; and a frame releasably mountable to the processing machine and provided with at least one auxiliary device mounted to the frame for the separation and withdrawal of individual sheet metal blanks by the separating device, whereby the at least one auxiliary device is installed on or removed from the processing machine by connecting or disconnecting the frame to the processing machine.

6. Modular magazine according to claim 5, wherein the at least one auxiliary device includes adjustable separation catch elements mounted on the frame for engaging a bottom blank of a stack of sheet metal blanks to set a predetermined sag of the bottom blank to be withdrawn from the stack by the separating device.

7. Modular magazine according to claim 5, wherein the at least one auxiliary device includes an air discharge mounted on the frame and adjustable with at least one degree of freedom to separate a blank from the stack of blanks to be withdrawn from the stack by the separating device.

8. Modular magazine according to claim 7, wherein the separating air discharge mounted on the frame is adjustable with three degrees of freedom.

9. Modular magazine according to claim 5 for use in a sheet metal blank processing machine, the processing machine having magazine supports, the modular magazine further comprising:

spacer elements that cooperate with the magazine supports for locating the frame at a predetermined position with respect to the separating device.

10. Modular magazine according to claim 9, wherein the spacer elements are vertically adjustable setting screws mountable to the frame.

11. Modular magazine according to claim 5, further comprising:

adjustable stack supports positioned only along one side of the stack of sheet metal blanks.

12. Modular magazine according to claim 5, wherein the adjustable stack supports are positioned on opposite sides of the stack of sheet metal blanks.

13. Sheet metal processing machine comprising:

a modular magazine for blanks to be individually fed from the magazine at a high rate; the magazine having adjustable stack supports to receive stacks of blanks of different sizes;

a frame to which one or more auxiliary devices are mounted for the separation and withdrawal of individual blanks from a stack; and a transfer device for transferring sheet metal blanks from the magazine for processing in the processing machine, whereby the at least one auxiliary device is installed on or removed from the machine by connecting or disconnecting the frame and the processing machine.

* * * * *